United States Patent [19]

Lane

[11] 4,230,258

[45] Oct. 28, 1980

[54] TRAY FOR A SHRINK-WRAP PACKAGE

[75] Inventor: Douglas C. Lane, Hyde, Nr. Manchester, England

[73] Assignee: Lancashire Box Company, Limited, Hyde, Nr. Manchester, England

[21] Appl. No.: 51,570

[22] Filed: Jun. 25, 1979

[30] Foreign Application Priority Data

Jun. 28, 1978 [GB] United Kingdom ..... 28193/78

[51] Int. Cl.[3] ..... B65D 5/20; B65D 71/08

[52] U.S. Cl. ..... 229/30; 206/45.33; 206/589; 206/590; 211/73

[58] Field of Search ..... 229/30, 16; 206/45.33, 206/588, 589, 590, 521, 562, 563; 211/73, 132

[56] References Cited

U.S. PATENT DOCUMENTS

| | | | |
|---|---|---|---|
| 2,331,038 | 10/1943 | Meller | 220/30 UX |
| 3,291,365 | 12/1966 | Koene | 206/590 X |
| 3,434,646 | 3/1969 | Schmidt | 229/16 R |
| 3,740,238 | 6/1973 | Graham | 206/45.33 |

FOREIGN PATENT DOCUMENTS

| | | | |
|---|---|---|---|
| 77663 | 2/1962 | France | 206/563 |
| 82521 | 1/1964 | France | 211/73 |

*Primary Examiner*—Davis T. Moorhead

*Attorney, Agent, or Firm*—Sughrue, Rothwell, Mion, Zinn and Macpeak

[57] ABSTRACT

A tray is erectable from a blank of sheet material for use in a shrink-wrap package. The tray comprises a first panel constituting a base, a second panel joined along one edge to the first panel, and a third panel joined along one edge to a second edge opposing said one edge of the second panel and extending between said second edge of the second panel and the base of the tray. A portion of the third panel is pierced to expose a cut edge which is profiled to conform substantially with a contour of an item it is desired to package on the tray whereby in use said contour abuts said edge to assist in retention of said item in position on the tray.

10 Claims, 4 Drawing Figures

TRAY FOR A SHRINK-WRAP PACKAGE

The present invention relates to trays for use in shrink-wrap packages.

Shrink-wrap packages usually comprise a tray or shallow dish of corrugated cardboard or similar sheet material on which are arranged items of goods to be packed. This arrangement is then enveloped by a plastics sheeting, which is usually transparent and which is stretched over the goods and the tray, and heated whereby on cooling the sheeting shrinks around the goods and the tray to form a neat package.

The object of the present invention is to provide an improved tray, which can be simply erected from a blank, and is suitable for use in a shrink-wrap package.

According to a first aspect of the present invention there is provided a tray erectable from a blank of sheet material and for use in a shrink-wrap package comprising a first panel constituting a base, a second panel joined along one edge to an edge of the first panel and constituting a side panel of the tray, and a third panel joined along one edge to a second edge opposing said one edge of the second panel and extending between said second edge of the second panel and the base of the tray, a portion of the third panel being pierced to expose a cut edge which is profiled to conform substantially with a contour of an item it is desired to package on the tray whereby in use said contour abuts said edge to assist in the retention of said item in position on the tray.

According to a second aspect of the present invention there is provided a blank for erection to a tray according to the first aspect of the present invention, the blank comprising a first panel joined along one edge thereof to one edge of a second panel, and a third panel joined along one edge thereof to a second edge of the second panel opposing said one edge and remote from said first panel, the third panel being pierced to define a cut edge which is profiled to conform substantially with a contour of an item it is desired to package on the tray when erected from the blank.

The present invention will now be described by way of example with reference to the accompanying drawing, in which.

Figure 1:
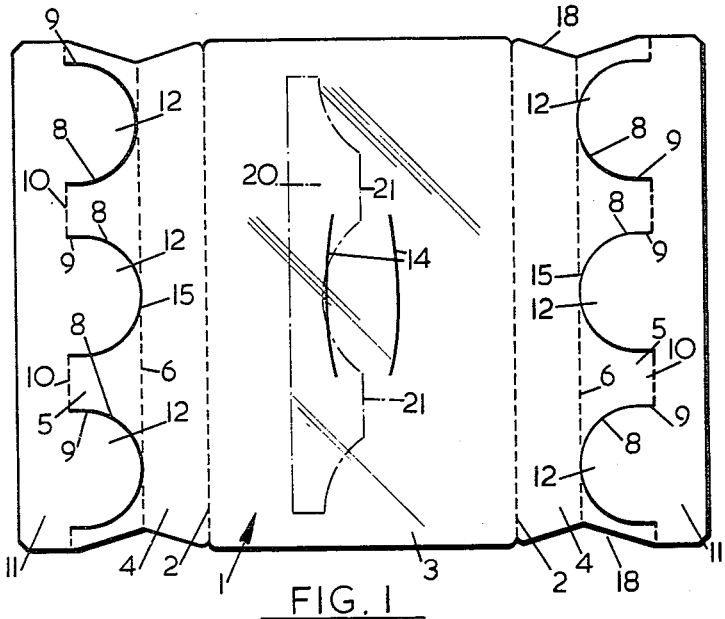
FIG. 1 shows a blank erectable to a tray for use in a shrink-wrap package according to the present invention.

Referring firstly to FIG. 1, the blank comprises a substantially rectangular piece of double-faced corrugated cardboard which has been cut and configured in known manner to form a plurality of panels and flaps.

The central portion 1 of the blank is defined by edges formed by opposed edges of the cardboard and by two parallel transverse hinge lines 2 and forms a first rectangular panel 3. Adjoining this panel 3 along the hinge lines 2 on either side thereof are two similar second panels 4, which in this example are each approximately one fifth the width of the first panel 3. Further third panels 5 adjoin the second panels along their edges 6 opposed to their hinged edges 2 adjoining the first panel 3. The second and third panels 4 and 5 are also hinged together along their common edge 6.

The third panels 5 are each pierced by three adjacent substantially semi-circular slits 8, the ends 9 of the slits 8 all terminating on a line 10 which defines an edge of the third panel 5 common with a fourth panel 11 adjacent thereto. The fourth panels 11 of the blank comprise end panels therefor.

Between the ends 9 of adjacent slits 8, the blank is partially hinges along the line 10. In this way three semi-circular flaps 12 defined by the slits 8 can be folded out of the plane of each of the third panels 5 as the fourth panels 11 are rotated with respect to the third panels 5 along the partially hinged line 10.

The blank as described above can be erected from a tray as shown in FIG. 2 as follows. Firstly, the second panels 4 are folded with respect to the first panel 3 along the hinge lines 2 so that the panel 3 forms a base and the panels 4 form side walls for the erected tray. The fourth panels 11 together with the flaps 12 are then folded along the partially hinged lines 10 so that they lie contiguous with the first panel 3 and edges 13 of the fourth panels lie adjacent the hinge lines 2. In this way, the third panels 5 are constrained to adopt a position extending between the common edges 6 with the side panels 4 and the base panel 3 of the tray to define acute angles with both the second and fourth panels 4 and 11.

In order to retain the tray in an erected state, an optional retaining means can be provided comprising a pair of adjacent oppositely curved slits 14 in the first panel 3. The slits 14 are positioned whereby an edge 15 of one of the flaps 12 cut from each of the panels 5 is passed through the adjacent slit 14 to retain the flaps 12 and panels 11 contiguous with the panel 3.

Figure 2:
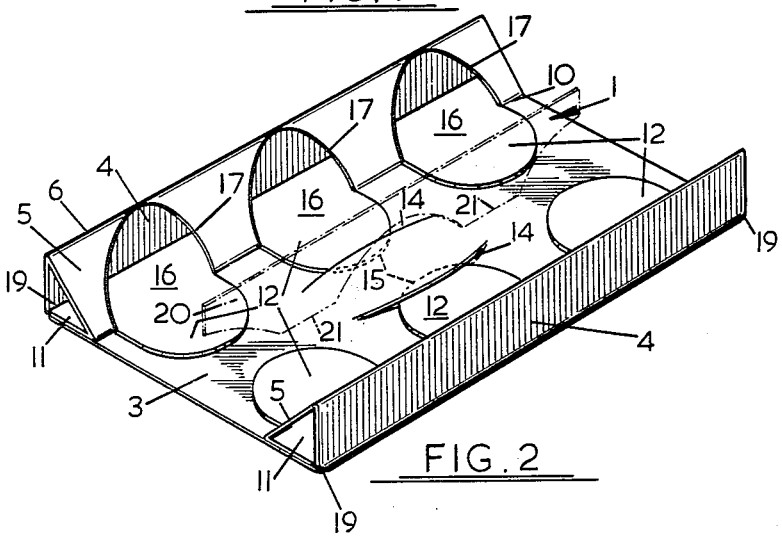
FIG. 2 is a perspective view of the tray formed by erection of the blank shown in FIG. 1.

In use, the tray as shown in FIG. 2 is suitable for holding six jars or bottles, one such jar or bottle being associated with each of the flaps 12 and complementary cut-away portions 16 of the third panels 11. It will be appreciated that as the flaps 12 are folded out of the planes of the panels 11 cut edges 17 of the slits 8 are exposed which edges 17 defines the cut-away portions 16. In order to retain items of goods to be packaged on the tray during use, it is advantageous to profile the slits 8 and thereby the edges 17 to conform substantially with a contour of the items to be packaged, which contour abuts a corresponding edge 17 in use.

As previously described the erected tray is particularly suitable for use as part of a shrink-wrap package and once items to be packed have been arranged thereon the tray and goods can be covered by a suitable plastics film in the normal way. To prevent piercing of the plastics film by the edges and corners of the tray, the edges of the blank can be contoured as at 18 to provide curved corners 19 in the erected tray.

It will be appreciated that the tray can be adapted to accommodate any number of items in either a single row or two abreast. If necessary, a dividing pad can be used to separate adjacent items on either side of the tray when these are arranged two abreast.

Such a dividing pad can be separate from the tray or integral therewith.

An integral dividing pad 20 is indicated in dotted lines in the FIG. 2. The desired outline of dividing pad 20 is cut in the first panel 3 save for a hinge line or lines. In this instance two hinge lines 21 are provided. It is to be noted that when pad 20 is provided slits 15 are omitted. When erecting the tray the dividing pad 20 is hinged about hinge lines 21 to a vertical attitude, and in this instance the weight of the articles to be packaged retain the tray in erected condition. The dividing pad 20 shown is used when it is desired to pack six mugs, two abreast. The provision of the pad separates each mug wholly from adjacent mugs.

The dividing pad could be any convenient shape depending on the articles to be packed.

Complete separation is particularly important when fragile articles made, for example of glass or pottery, are to be packaged.

Figure 3:
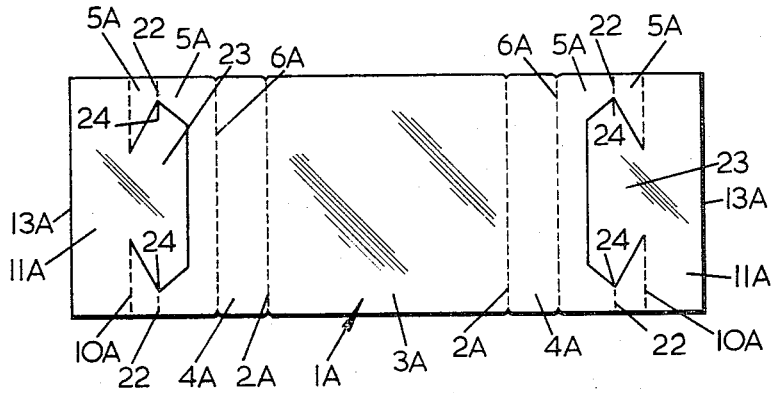
FIG. 3 is a second blank showing a modification of the blank of FIG. 1.
Figure 4:
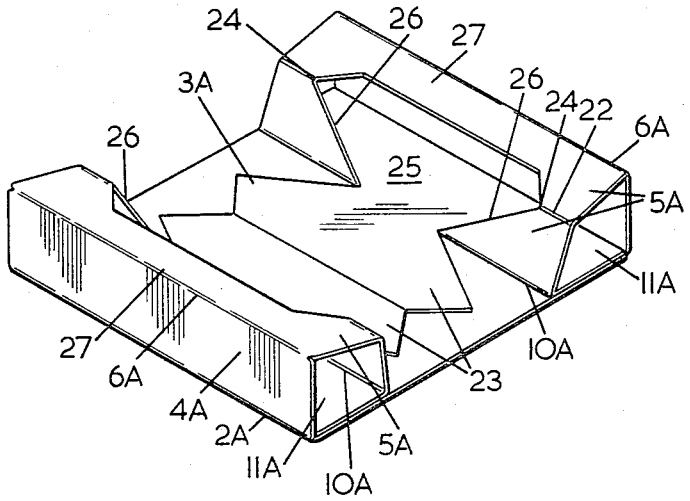
FIG. 4 is a perspective view of the modified tray formed by erection of the blank shown in FIG. 3.

FIGS. 3 and 4 show a blank and a tray made therefrom similar to those shown in FIGS. 1 and 2 respectively and the same reference numerals are used in these figures to indicate similar portions thereof but with the suffix "A".

In FIG. 3 it can be seen that the third panels 5A are each provided with hinged lines 22 whereby the panels 5A are cranked in the erected tray, as shown in FIG. 4, between the edges 2A of the second panels 4A and the base 3A of the tray. The panels 5A are each provided with a substantially hexagonal flap 23 which has opposed pointed ends as at 24 and it can be seen that the hinged lines 22 extend between the points 24 of the flaps 23 and the side edges of the blank.

The blank shown in FIG. 3 is erected to the tray of FIG. 4 in a similar manner to that described for FIG. 1. The flaps 23 fold out of the panels 5A to leave substantially hexagonal apertures 25 with contoured edges 26 suitable for accommodating a stack of plates. It can be seen that, in the erected tray, the uppermost portions 27 of the panel 5A will overlie the rim of the top plate of such a stack of plates while the contoured edges 26 conform to the adjacent contours of the edges of the plates. As before, such a tray loaded with plates can then be covered with a shrink-wrap film.

The tray according to the invention has several advantages over conventional trays. For example, the first panel 3, 3A forms a rigid base to enable stacking of a plurality of trays to be accomplished. Additionally, the flaps 12, 23 provide a double thickness of material at the base of the tray, which is its most vulnerable area for damage. The blanks and trays are easily manufactured without being more expensive than existing blanks and trays and are, indeed, cheaper to produce than many.

What is claimed is:

1. A tray erectable from a blank of sheet material and for use in a shrink-wrap package, the tray comprising a first panel constituting a base, a second panel joined along one edge to an edge of the first panel and constituting a side panel of the tray, and a third panel joined along one edge to a second edge opposing said one edge of the second panel and extending between said second edge of the second panel and the base of the tray, a portion of the third panel being pierced to expose a cut edge which is profiled to conform substantially with a contour of an item it is desired to package on the tray whereby in use said contour abuts said edge to assist in retention of said item in position on the tray.

2. A tray as claimed in claim 1, in which said portion of the third panel is pierced to form a flap which is folded out of the plane of the third panel to expose said profiled cut edge.

3. A tray as claimed in claim 2, in which the flap is folded to lie contiguous with the base of the tray.

4. A tray as claimed in any one of claims 1 to 3, in which a retention means is provided on the base of the tray to lock the latter in an erected state.

5. A tray as claimed in claim 4 in which the retention means comprises a slit through which an edge of a flap can be passed.

6. A tray as claimed in any one of claims 1 to 3, in which the base of the tray is pierced to provide a dividing pad which can be hinged out of the plane of the base for disposition between two items which it is desired to package on the tray.

7. A tray as claimed in any one of claim 1 to 3, in which the third panel is hinged and cranked to provide a portion thereof which can overlie an item packaged on the tray.

8. A tray as claimed in claim 7, in which the pierced portion of the third panel defines a substantially hexagonal aperture with a pointed cut edge profiled to conform with a contour of the edge defined by a stack of plates.

9. A blank for erection to a tray as claimed in claim 1, comprising a first panel joined along one edge thereof to one edge of a second panel, and a third panel joined along one edge thereof to a second edge of the second panel opposing said one edge and remote from said first panel, the third panel being pierced to define a cut edge which is profiled to conform substantially with a contour of an item it is desired to package on the tray when erected from the blank.

10. A blank as claimed in claim 9, in which the third panel is pierced to define a flap which can be folded out of the plane of the third panel.

* * * * *